US007871250B2

(12) United States Patent
Yajima

(10) Patent No.: US 7,871,250 B2
(45) Date of Patent: Jan. 18, 2011

(54) CHEMICAL LIQUID SUPPLYING APPARATUS

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 710 days.

(21) Appl. No.: 11/938,927

(22) Filed: Nov. 13, 2007

(65) Prior Publication Data

US 2008/0115662 A1 May 22, 2008

(30) Foreign Application Priority Data

Nov. 20, 2006 (JP) ..... 2006-312621

(51) Int. Cl.
*F04B 9/08* (2006.01)
*F16J 3/04* (2006.01)

(52) U.S. Cl. ..... 417/388; 417/389; 277/389; 277/636

(58) Field of Classification Search ..... 417/383, 417/388, 389, 394, 395; 277/389, 392, 636; 92/90

See application file for complete search history.

(56) References Cited

U.S. PATENT DOCUMENTS

| | | | | |
|---|---|---|---|---|
| 2,951,450 | A * | 9/1960 | Fisher | 417/273 |
| 4,890,851 | A * | 1/1990 | Avard et al. | 277/392 |
| 5,011,166 | A * | 4/1991 | Watts | 277/379 |
| 5,085,560 | A * | 2/1992 | Thompson et al. | 417/53 |
| 5,167,837 | A | 12/1992 | Snodgrass et al. | |
| 5,516,429 | A * | 5/1996 | Snodgrass et al. | 210/767 |
| 6,183,223 | B1 | 2/2001 | Yajima | |
| 6,193,783 | B1 | 2/2001 | Sakamoto et al. | |

FOREIGN PATENT DOCUMENTS

| | | |
|---|---|---|
| JP | 41-6418 | 4/1963 |
| JP | 03-149371 | 6/1991 |
| JP | 10-61558 | 3/1998 |
| JP | 2000-12449 | 1/2000 |
| JP | 2002242842 | 8/2002 |
| JP | 2004-50026 | 2/2004 |
| JP | 2006-144741 | 6/2006 |
| JP | 2006266250 | 10/2006 |

OTHER PUBLICATIONS

Japanese Office Action dated Mar. 16, 2010.

* cited by examiner

*Primary Examiner*—Devon C Kramer
*Assistant Examiner*—Patrick Hamo
(74) *Attorney, Agent, or Firm*—McCormick, Paulding & Huber LLP

(57) ABSTRACT

A chemical liquid supplying apparatus can discharge chemical liquid with high accuracy and monitor a leakage of an incompressible medium from a region between a piston and a cylinder. A pump has a flexible tube for partitioning a pump chamber and a drive chamber, and the incompressible medium is supplied to the drive chamber by the piston reciprocating in a cylinder hole of the cylinder. A bellows cover is provided between the piston and the cylinder, and forms a seal chamber contiguous to a sliding face of the piston. A seal-chamber pressure sensor is attached to the cylinder so as to detect the pressure of the incompressible medium for sealing enclosed in the seal chamber, and a deterioration degree of a seal member is determined by detecting the pressure in the seal chamber.

9 Claims, 6 Drawing Sheets

CHEMICAL LIQUID SUPPLYING APPARATUS

CROSS-REFERENCE TO RELATED APPLICATIONS

Applicant hereby claims foreign priority benefits under U.S.C. §119 from Japanese Patent Application No. 2006-312621 filed on Nov. 20, 2006, the contents of which are incorporated by reference herein.

TECHNICAL FIELD OF THE INVENTION

The present invention relates to a chemical liquid supplying apparatus which discharges a predetermined amount of chemical liquid such as photoresist liquid.

BACKGROUND OF THE INVENTION

A fine circuit pattern is produced on a surface of a semiconductor wafer or liquid crystal glass substrate by a photolithography process and an etching process. In the photolithography process, a chemical liquid supplying apparatus has been used to apply chemical liquid such as photoresist liquid to a surface of a wafer or glass substrate, and the chemical liquid accommodated in a container is sucked up by a pump, passes through a filter or the like, and is applied to an object to be applied such as a wafer from a nozzle. Japanese Patent Application Laid-Open Publication No. 2000-12449 (Patent Document 1) describes a treatment liquid supplying apparatus for supplying photoresist liquid to a wafer, and Japanese Patent Application Laid-Open Publication No. 2004-50026 (Patent Document 2) describes an application apparatus for supplying photoresist liquid to a liquid crystal glass substrate.

In such a chemical liquid supplying apparatus, if particles such as dust and dirt enter into the chemical liquid to be applied, they adhere to the object to be applied, whereby any pattern defects are caused and a yield of products is reduced. If the chemical liquid in a container is accumulated in a pump, it changes in quality. Therefore, since the chemical liquid changed in quality may become particles in some cases, the pump for discharging the chemical liquid is demanded not to be accumulated.

A pump in which a pump chamber supplying the chemical liquid and a drive chamber expanding/contracting the pump chamber are partitioned by an elastically deformable diaphragm or a partition film such as a tube is used as a pump for discharging the chemical liquid. The drive chamber is filled with indirect liquid, namely, an incompressible medium so as to pressurize the chemical liquid through the partition film. A pressurizing system of the incompressible medium includes a bellows type as described in Japanese Patent Application Laid-Open No. 10-61558 (Patent Document 3) and a syringe type of using a piston as disclosed in U.S. Pat. No. 5,167,837 (Patent Document 4).

A reciprocating pump for discharging liquefied gas includes, as described in Japanese Patent Application Laid-Open Publication No. 2006-144741 (Patent Document 5), a type of using a bellows to seal fluid in a piston from the outside.

SUMMARY OF THE INVENTION

When the diaphragm or tube is elastically deformed by the incompressible medium to perform a pump operation, accumulation of the chemical liquid can be prevented in an expansion/contraction chamber of the pump. Therefore, although generation of the particles due to the accumulation of the chemical liquid can be prevented, the incompressible medium results in playing an important role in determining performance of the pump. That is, if air enters into the incompressible medium from the outside, incompressibility of the incompressible medium is macroscopically lost, so that motion of the bellows or piston cannot be accurately transmitted to the diaphragm or tube and a movement stroke of the bellows or piston results in not corresponding to a discharge amount of chemical liquid. Further, similarly thereto, also when the incompressible medium leaks out, the movement stroke of the bellows results in not corresponding to the discharge amount of chemical liquid, so that the chemical liquid cannot be discharged with high accuracy.

In the pump of the syringe type disclosed in Patent Document 4 mentioned above, a seal member contacting with an outer peripheral surface of the piston is generally provided on the cylinder to seal a region between an interior of the drive chamber on a tip face side of the piston and an exterior on a basal end face side of the piston, whereby the piston uses the seal member as a boundary to reciprocate between a portion in which the incompressible medium exists and the outside. Thus, the incompressible medium is sometimes exposed to the outside while adhering to the outer peripheral surface of the piston. The adhering incompressible medium becomes a thin-file shape and enters into a region between the outer peripheral surface and the seal member, thereby serving as lubricant to avoid direct contact between the seal member and the outer peripheral surface of the piston. However, since part of the incompressible medium exposed to the outside evaporates or dries little by little, it disappears from the surface of the piston and an amount of incompressible medium is reduced. Further, if the incompressible medium exposed to the outside vaporizes, the incompressible medium serving as lubricant disappears from the outer peripheral surface of the piston and becomes in no oil-film state. Consequently, the seal member directly contacts with the outer peripheral surface of the piston, whereby frictional wear of the seal member progresses.

When the piston moves backward in order to suck the chemical liquid in the container into the pump chamber by expanding the drive chamber partitioned by the partition film, since the incompressible medium becomes in a negative pressure state, ambient air may enter into the incompressible medium in the drive chamber from a region between the outer peripheral surface of the piston and an inner peripheral surface of the cylinder. This phenomenon becomes significant when the seal member slidably contacting with the outer peripheral surface of the piston is worn and a sealing property is lowered, and the same phenomenon occurs even when large negative pressure is applied to the incompressible medium by the piston.

Contrary to this, since the pump of the above-mentioned bellows type does not use the seal member contacting with the sliding face, there is the advantage that airtight properties of the drive chamber filled with the incompressible medium and the pump chamber pressurizing the chemical liquid are high. However, there is such a tendency that pressure applied to the incompressible medium in the bellows type is lower than that in the syringe type. For example, when resist is discharged to the nozzle through a filter, since flow resistance of the filter is large, the pressure in the pump chamber needs to be increased. Consequently, when the bellows is driven, the pressure of the incompressible medium in the drive chamber becomes high, so that the bellows may be expanded slightly radially. At this time, if the bellows is expanded, a movement stroke of the bellows results in not corresponding to the discharge amount of chemical liquid with high accuracy.

The pump of the above-mentioned syringe type is preferred to increase discharge pressure of the pump. However, as the frictional wear of the seal member progresses, the incompressible medium in the drive chamber results in leaking to the outside. Thus, the seal member may be replaced periodically. Similarly also in a chemical-liquid discharge pump of a type of preventing a leakage of the incompressible medium in the drive chamber by narrowing a gap between the outer peripheral surface of the piston and the inner peripheral surface of the cylinder, as the frictional wear of the sliding face between the piston and the cylinder progresses, the incompressible medium in the drive chamber leaks to the outside, so that the piston and the cylinder need to be replaced.

Accordingly, if any leakage of the incompressible medium in the drive chamber from the sliding face between the piston and the cylinder can the detected from the outside, a replacement period of the seal member and a replacement period of the piston, etc. can be determined.

An object of the present invention is to provide a chemical liquid supplying apparatus which can discharge chemical liquid with high accuracy.

Another object of the present invention to provide the chemical liquid supplying apparatus in which an incompressible medium is prevented from leaking from a region between a piston and a cylinder.

Still another object of the present invention is to provide the chemical liquid supplying apparatus in which a film of the incompressible medium is interposed in a seal member for sealing the region between the piston and the cylinder to improve a lubricating property of the seal member.

Still another object of the present invention is to provide the chemical liquid supplying apparatus which can monitor a leakage of the incompressible medium in a drive chamber from the region between the piston and the cylinder.

Yet still another object of the present invention is to provide the chemical liquid supplying apparatus which can determine a lifetime according to an amount of leakage of the incompressible medium in the drive chamber.

A chemical liquid supplying apparatus according to the present invention comprises: a pump provided with an elastically deformable partition film for partitioning a drive chamber and a pump chamber communicating with a liquid inflow port and a liquid outflow port; a cylinder incorporating reciprocably, into the drive chamber, a piston for supplying/exhausting an incompressible medium to/from the drive chamber, the cylinder having a sliding face slid by a sliding face of the piston; a driving means for reciprocating axially the piston to expand/contract the pump chamber via the incompressible medium; and an elastic deformable member provided between the piston and the cylinder and forming a seal chamber for enclosing the incompressible medium so as to be contiguous to the sliding face of the piston.

The chemical liquid supplying apparatus according to the present invention is such that the elastic deformable member is formed by a bellows cover, and an average effective diameter of the bellows cover is set so as to be approximately equal to an outer diameter of the sliding face of the piston.

The chemical liquid supplying apparatus according to the present invention is such that a small-diameter portion with a diameter smaller than the outer diameter of the sliding face is formed on the piston, the bellows cover is provided between an opening end portion of the cylinder and a basal end portion of the piston, and the seal chamber is formed between the bellows cover and the small-diameter portion.

The chemical liquid supplying apparatus according to the present invention is such that a large-diameter hole with a diameter larger than an inner diameter of the sliding face of the cylinder is formed on the cylinder, the bellows cover is provided between a basal end portion of the piston and an opening end portion of the cylinder, and the seal chamber is formed between the bellows cover and the large-diameter hole.

The chemical liquid supplying apparatus according to the present invention further comprises a seal-chamber pressure detecting means for detecting pressure in the seal chamber.

The chemical liquid supplying apparatus according to the present invention further comprises a drive-chamber pressure detecting means for detecting pressure in the drive chamber.

In the chemical liquid supplying apparatus according to the present invention, the drive chamber is partitioned by the piston and a partition film provided in the cylinder. Further, in the chemical liquid supplying apparatus according to the present invention, the drive chamber comprises a pump-side drive chamber provided to the pump and a piston-side drive chamber formed by the cylinder and the piston.

In the chemical liquid supplying apparatus according to the present invention, the partition film is a diaphragm. Further, in the chemical liquid supplying apparatus according to the present invention, the partition film is a tube.

According to the present invention, the drive chamber filled with the incompressible medium is expanded/contracted by the piston to expand/contract the pump chamber via the incompressible medium, higher pressure can be applied to the incompressible medium than pressurization applied to the incompressible medium by the bellows. Consequently, even if higher flow resistance is applied to the pump chamber when the pump chamber is contracted, the chemical liquid can be supplied.

The seal chamber contiguous to the sliding faces of the piston and the cylinder is formed by the elastic deformable member such as a bellows cover provided between the piston and the cylinder, wherein the incompressible medium is enclosed in the seal chamber. Thus, since the elastic deformable member for forming the seal chamber has no sliding portion, the leakage of the incompressible medium from the elastic deformable member can be prevented completely. Therefore, even if the incompressible medium enclosed inside leaks out from the sliding portion between the piston and the cylinder by pressurizing the drive chamber using the piston, the incompressible medium flows into the seal chamber, so that the leakage of the incompressible medium to an exterior of the apparatus is prevented.

Thus, since the sliding portion between the piston and the cylinder is contiguous to the seal chamber, the seal member for sealing a region between the piston and the cylinder is used as a boundary to fill both axially-directional sides of the seal member with the incompressible medium. Therefore, the incompressible medium which has become a thin-film shape is interposed between the seal member and a portion contacting therewith. Consequently, a lubricating property of the seal member is enhanced and prevents friction wear of the seal member. This can improve durability of the seal member.

Even if the incompressible medium in the seal chamber enters into the drive chamber due to such a phenomenon that the pressure in the drive chamber becomes lower than external pressure by driving the piston in a direction of extracting the drive chamber, compressible fluid such as air does not enter into the drive chamber. Therefore, a movement stroke of the piston can be caused to correspond to a deformation volume of the pump chamber with high accuracy, and the amount of the chemical liquid discharged from the pump can be made to be with high accuracy.

The seal chamber contiguous to the drive chamber via the sliding portion is partitioned by the elastic deformable member such as a bellows cover. Therefore, even if the seal member provided to the sliding portion between the piston and the cylinder is worn frictionally due to variation across the ages, the entering of air into the drive chamber is prevented. Accordingly, a replacement period and a maintenance period of the seal member can be set longer, and the durability of the chemical liquid supplying apparatus can be improved.

If a gap between the piston and the cylinder is set to be narrow for obtaining a sealing effect like an injection syringe without using the seal member, there is the advantage that no stick-slip phenomenon specific for the seal member occurs, thereby making it possible to discharge stably the chemical liquid. When the seal member is not used, there is generally the drawback that the leakage of the incompressible medium and entering of air into the drive chamber occur easily, thereby deteriorating the sealing property. However, since such a drawback is eliminated by forming the seal chamber using the elastic deformable member provided between the piston and the cylinder, the durability of the chemical liquid supplying apparatus can be improved while the stable discharge of the chemical liquid is maintained.

When the seal member provided between the sliding face of the piston and the sliding face of the inner peripheral surface of the cylinder hole is worn or when the sealing property is secured between both the sliding faces without providing the seal member therebetween, if the sliding faces are worn, the sealing property is deteriorated, thereby causing the leakage of the incompressible medium from the drive chamber to the seal chamber. Since the pressure in the seal chamber varies due to the leakage, a deterioration degree of the sealing property can be determined according to the leakage amount of the incompressible medium by detecting the pressure in the seal chamber. The lifetime of the seal member can be determined, and when no seal member is used, the replacement period of a part such as a piston can be determined.

When the sealing property is deteriorated, a characteristic of a pressure change of the drive chamber varies. Therefore, the deterioration degree of the sealing property can be detected by detecting the pressure in the drive chamber. Similarly, the lifetime or the like of the seal member can also be determined.

If the pressure in the seal chamber and the pressure in the drive chamber are detected, the deterioration degree of the sealing property can be determined more accurately in view of an influence of pressure fluctuation in the seal chamber due to pressure fluctuation in the drive chamber.

DESCRIPTION OF THE PREFERRED EMBODIMENTS

Figure 1:
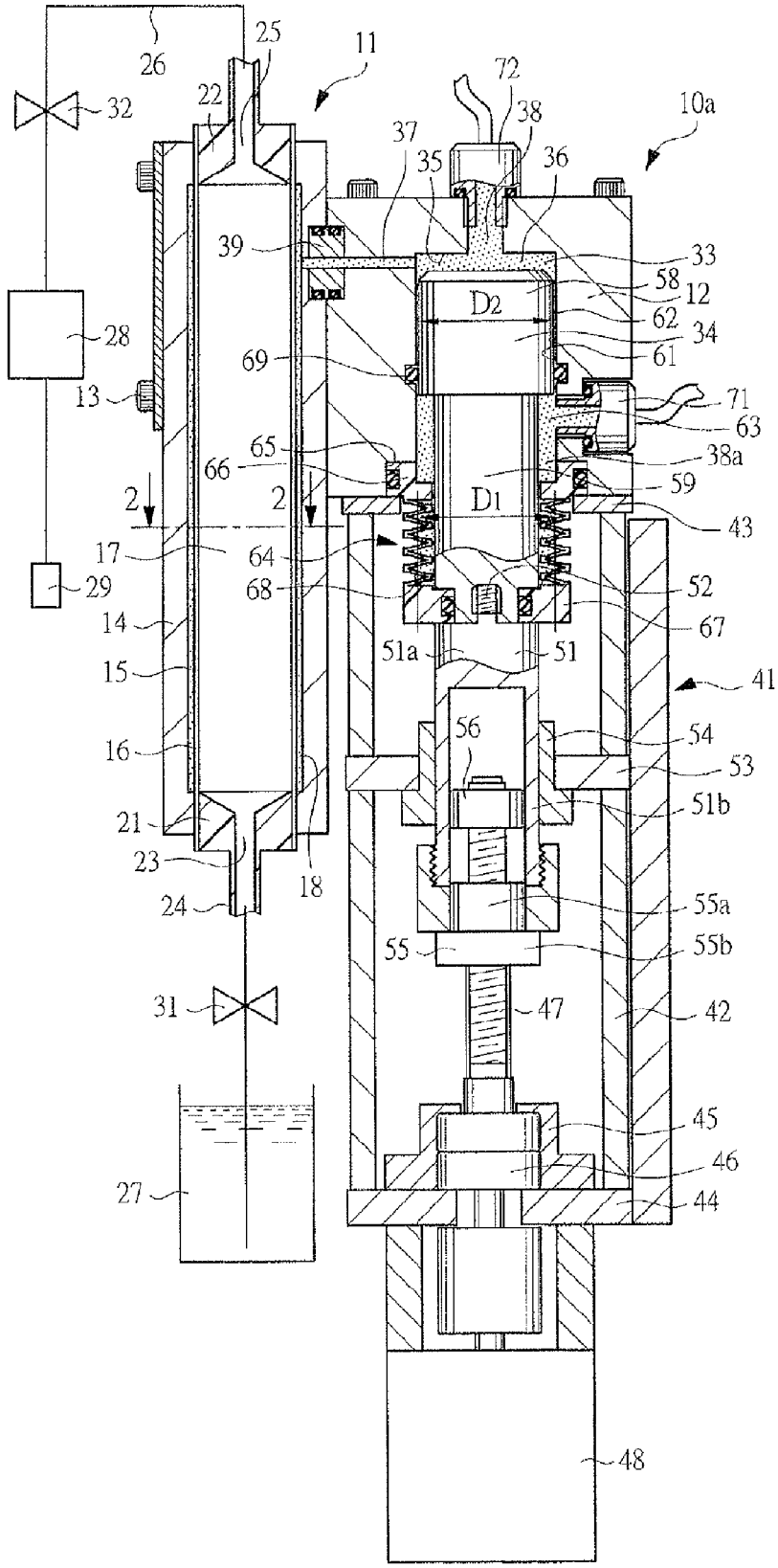
FIG. 1 is a sectional view showing a chemical liquid supplying apparatus according to one embodiment of the present invention.
Figure 2:
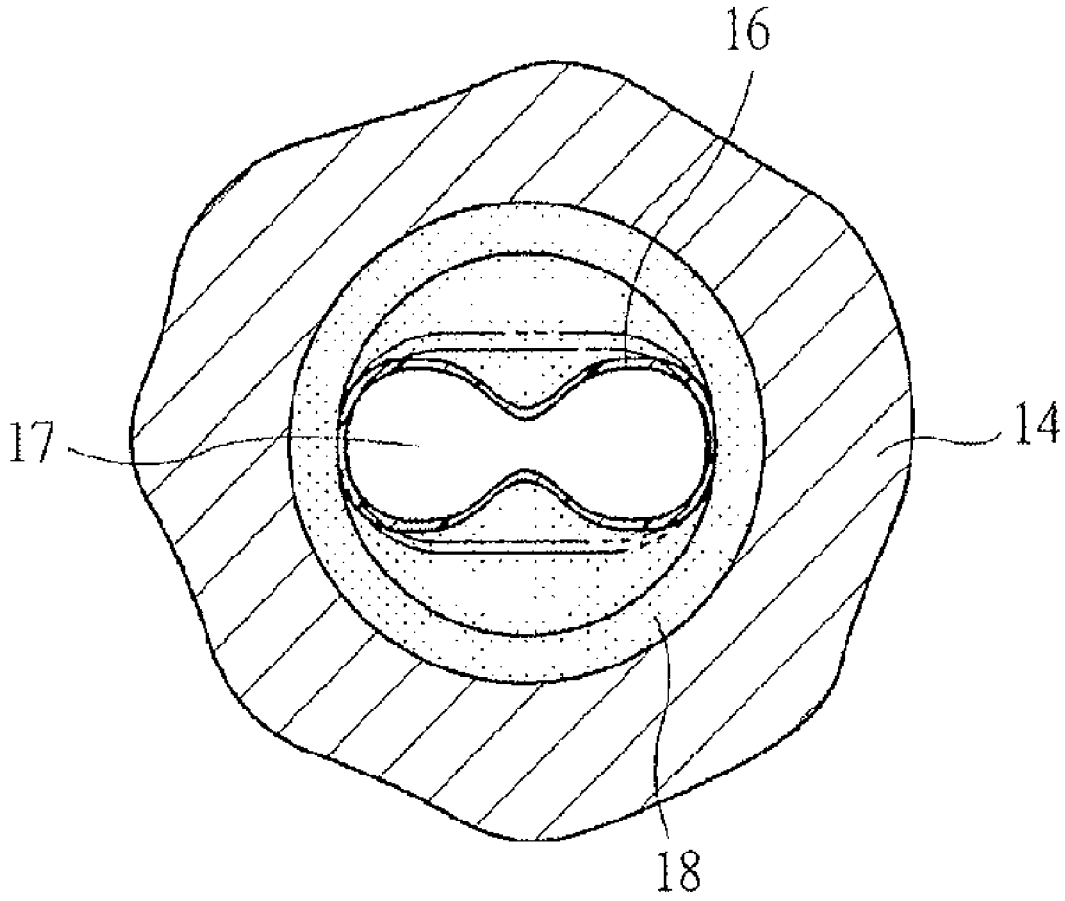
FIG. 2 is a sectional view taken along line 2-2 of FIG. 1.

Hereinafter, embodiments of the present invention will be described in detail with reference to the drawings. FIG. 1 is a sectional view showing a chemical liquid supplying apparatus 10*a* according to one embodiment of the present invention, and FIG. 2 is a sectional view taken along line 2-2 of FIG. 1.

The chemical liquid supplying apparatus 10*a* has a pump 11 and a cylinder 12. The pump 11 has a pump case 14 fixed to the cylinder 12 by a bolt 13, and a flexible tube 16 attached inside a cylindrical space 15 in the pump case 14. The flexible tube 16 is formed by a radially expandably/contractably elastic member, whereby the flexible tube 16 partitions the space 15 into a pump chamber 17 inside the flexible tube and a pump-side drive chamber 18 outside the flexible tube. The flexible tube 16 constitutes a partition film.

Adapter portions 21 and 22 are attached to both end portions of the flexible tube 16. A liquid inflow port 23 communicating with the pump chamber 17 is formed in the adapter portion 21 and connected to a supply-side flow path 24, and a liquid outflow port 25 communicating with the pump chamber 17 is formed in the adapter portion 22 and connected to a discharge-side flow path 26. The supply-side flow path 24 is connected to a chemical-liquid tank 27 which accommodates chemical liquid such as resist liquid, and the discharge-side flow path 26 is connected to an application nozzle 29 via a filter 28.

The flexible tube 16 is formed of a tetrafluoroethylene-perfluoroalkyl vinylether copolymer (PFA) which is a fluorine resin, and the adapter portions 21 and 22 are also formed of PFA. These members formed of PFA do not react with photoresist liquid. However, these members are not limited to PFA by kinds of used liquid, and a flexible material such another resin material or rubber material may be used as a raw material of the flexible tube 16 as long as being elastically deformed. Another resin material or metal material may be used as a raw material of each of the adapter portions 21 and 22.

The supply-side flow path 24 is provided with a supply-side opening/closing valve 31 for opening/closing this flow path, and the discharge-side flow path 26 is provided with a discharge-side opening/closing valve 32 for opening/closing this flow path. Each of the opening/closing valves 31 and 32 includes a solenoid valve which is actuated according to an electric signal, a motor-driven valve, or an air operation valve which is actuated by pneumatic pressure. Further, a check valve may be used.

A piston 34 is assembled axially reciprocably into a bottomed cylinder hole 33 formed in the cylinder 12, and a piston-side drive chamber 36 is formed between a tip surface of the piston 34 and a bottom surface 35 of the cylinder hole 33. The piston-side drive chamber 36 communicates with the pump-side drive chamber 18 by a communicating hole 37 formed in the cylinder 12. Liquid as an incompressible medium 38 for driving is enclosed in both the drive chambers 18 and 36, and the incompressible medium 38 in the drive chamber 18 communicates with that in the drive chamber 36 via the communicating hole 37. Therefore, when the piston 34 is advanced toward the bottom surface 35, the piston-side drive chamber 36 is contracted and the incompressible medium 38 in the drive chamber 36 flows into the pump-side drive chamber 18, so that the pump chamber 17 inside the flexible tube 16 is contracted. On the other hand, when the piston 34 is moved backward, the piston-side drive chamber 36 is expanded and the incompressible medium 38 in the pump-side drive chamber 18 flows into the drive chamber 36, so that the pump chamber 17 is expanded.

In the pump 11 having the flexible tube 16 and the pump case 14, when the piston 34 in the cylinder 12 is reciprocated, the pump chamber 17 is expanded/contracted by movement of the incompressible medium 38 enclosed in both the drive chambers 18 and 36, and the supply-side opening/closing valve 31 and the discharge-side opening/closing valve 32 are closed/opened in conjunction with expansion/contraction of the pump chamber 17, so that the chemical liquid in a chemical-liquid tank 27 is supplied to an application nozzle 29.

The pump case 14 constituting the pump 11 is attached to the cylinder 12, and a seal piece 39 with a seal member is build between the pump case 14 and the cylinder 12 in order to prevent a leakage of the incompressible medium 38 from a region between the pump case 14 and the cylinder 12. However, the pump case 14 and the cylinder 12 may be formed by an integral member. Further, the pump case 14 may be separated from the cylinder 12 and then the pump case 14 and the cylinder 12 may be connected through a hose or tube having a communicating hole.

FIG. 2 is a sectional view taken along line 2-2 in FIG. 1. The flexible tube 16 as a pump member has an elongated circle shape in cross section except portions to be fitted to the adapter sections 21 and 22, and comprises flat portions and circular arc portions. When the piston 34 reaches almost a forward limit position as shown in FIG. 1, the flexible tube 16 is contracted so that the flat portions approach each other as shown by solid lines in FIG. 2. When the piston 34 reaches a backward limit position, the flexible tube 16 turns to the elongated circular shape so that the flat portions are parallel to each other as shown by double-dot lines in FIG. 2. However, a lateral sectional shape of the flexible tube 16 is not limited to the elongated circular shape and may be formed into another shape such as circular.

The cylinder 12 is attached to a drive box 41, and the drive box 41 has a box main body 42 with a rectangular section, wherein end walls 43 and 44 are fixed to both ends of the box main body. A bearing 46 is fixed on an inner surface of the end wall 44 by a bearing holder 45, and a ball screw shaft 47 is supported by the bearing 46 so as to be rotatable at a basal end portion of the ball screw shaft. The ball screw shaft 47 is connected to a main shaft of a motor 48 serving as a drive means fixed outside the end wall 44, so that the ball screw shaft 47 is rotated both in normal and inverse directions by the motor 48.

A drive sleeve 51 is linked to a rear end of the piston 34, and the drive sleeve 51 has an end wall portion 51*a* provided integrally with a male screw portion 52; and a cylinder portion 51*b* integrated therewith. The male screw portion 52 is screwed to a screw hole formed on an end portion of the piston 34, and the cylindrical portion 51*b* is supported axially movably by a guide cylinder 54 fixed to a supporting plate 53 within the drive box 41. The ball screw shaft 47 is incorporated inside and coaxially with the drive sleeve 51, and a nut 55 screwed to the ball screw shaft 47 is fixed to an opening end portion of the drive sleeve 51. The nut 55 has a screw portion 55*a* to be fitted inside the drive sleeve 51 and a flange portion 55*b* integrated therewith. The flange portion 55*b* is fastened to the drive sleeve 51 by a screw member (not shown). Therefore, when the motor 48 drives the ball screw shaft 47 for rotation, the drive sleeve 51 is guided by the guide cylinder 54 via the nut 55, thereby reciprocating axially linearly. A guide ring 56 is mounted on a tip portion of the ball screw shaft 47 so that the ball screw shaft 47 is not tilted when the ball screw shaft 47 is rotated, and this guide ring 56 is fitted to an inner peripheral surface of the drive sleeve 51.

Splines are formed on an inner peripheral surface of the guide cylinder 54 for guiding the drive sleeve 51 to axial movement and an outer peripheral surface of the drive sleeve 51. Therefore, if a ball is interposed between the both splines, when the piston 34 is driven by the motor 48 via the drive sleeve 51, sliding resistance of the drive sleeve 51 can be reduced and further an above structure has a function of restricting rotation of the drive sleeve 51.

The piston 34 has a large-diameter portion 58 on a tip portion side and a small-diameter portion 59 on a basal end portion side. An outer peripheral surface of the large-diameter portion 58 is intended to be a sliding face 62 which slidably contacts with a sliding face 61 serving as the inner peripheral surface of the cylinder hole 33. A bellows cover 64 for forming a seal chamber 63 contiguous to the sliding face 62 of the piston 34 is provided as an elastic deformable member between the piston 34 and the cylinder 12. The bellows cover 64 has: an annular portion 66 fixed to a large-diameter hole 65 formed at an opening end portion of the cylinder 12; an annular portion 67 fixed to a projection portion, i.e., a basal end portion of the piston 34; and a bellows portion 68 provided therebetween. The bellows cover 64 is formed of a resin material such as PTFE (Polytetrafluoroethylene). However, it may be formed of a rubber material or metal material. The bellows cover 64 is provided so as to cover a basal end portion side of the outer peripheral surface of the piston 34. The seal chamber 63 contiguous to the sliding faces 61 and 62 is formed between the bellows cover 64 and an outer peripheral surface of the small-diameter portion 59 of the piston 34. An incompressible medium 38a for sealing is enclosed in the seal chamber 63. Incidentally, a diaphragm may be used as an elastic deformable member instead of the bellows cover 64.

As the incompressible medium 38*a* enclosed in the seal chamber 63, the same kind of medium as that of the incompressible medium 38 to be enclosed in the drive chambers 18 and 36 is used. However, the incompressible medium 38*a* may be different from the incompressible medium 38 in kind.

In order to seal a region between the sliding face 61 of the cylinder 12 and the sliding face 62 of the piston 34, a seal member 69 is mounted in an annular groove formed in the cylinder 12, whereby the sliding face 62 of the reciprocating piston 34 slidably contacts with the seal member 69. Incidentally, there may be adopted a structure in which an annular groove is formed on the outer peripheral surface of the piston 34 and the seal member 69 is mounted into the annular groove. In this case, the seal member 69 slidably contacts with the sliding face 61 of the cylinder hole 33 during reciprocation of the piston 34.

Since the bellows portion 68 of the bellows cover 64 is formed so that cone-shaped portions are continuous to each other, an inner diameter of the bellows portion varies depending on axial-directional positions. If it is assumed that an average effective diameter of axial-directional entirety of the bellows portion 68 is "D1", the average effective diameter D1 is set so as to be approximately equal to an outer diameter D2 of the sliding face 62 of the piston 34 (D1=D2). Therefore, an average effective area of the bellows portion 68 is set so as to be approximately equal to a sectional area of the piston 34. When the piston 34 is reciprocated axially and the bellows portion 68 of the bellows cover 64 is deformed axially elastically, volume of the seal chamber 63 does not vary. As a result, when the piston 34 is reciprocated, the bellows portion 68 of the bellows cover 64 is deformed only axially, but not deformed radially.

A diameter approximately equal to the outer diameter D2 within the average effective diameter D1 includes an allowable error if the slightly radial-directional deformation of the bellows portion 68 is within such a degree as not to deteriorate durability of the bellows cover 64 during the reciprocation of the piston 34. A gap between the sliding face 62 of the piston 34 and the sliding face 61 of the cylinder hole 33 is set to, for example, 0.5 mm or less, namely, a very small gap. Even if the average effective diameter D1 of the bellows portion 68 is set to be equal to an inner diameter of the cylinder 33, the bellows portion 68 is hardly deformed radially during the reciprocation of the piston 34. Therefore, the durability of the bellows cover 64 can be maintained. Accordingly, the allowable error of the outer diameter D2 also includes an inner-diameter dimension of the cylinder hole 33.

In the chemical liquid supplying apparatus 10*a*, since the incompressible medium 38 in the piston-side drive chamber 36 is pressurized by the piston 34 to supply the incompressible medium 38 from the piston-side drive chamber 36 to the pump-side drive chamber 18, the pressure in the pump-side drive chamber 18 can be increased. The incompressible medium 38 in the piston-side chamber 36 is sealed by the seal member 69. When the drive chamber 36 is pressurized by the piston 34, the impressible medium 38 adhering to the outer peripheral surface, i.e., the sliding face 62 of the piston 34 passes through a slight gap between the seal member 69 and the sliding face 62 due to the pressure of the drive chamber 36, and the incompressible medium 38 may be guided outside the cylinder 12 rather than the opening end of the cylinder 12 and then be leaked. However, the incompressible medium 38 adhering to the outer peripheral surface of the piston 34 and leaking to the outside is taken into the incompressible medium 38*a* in the seal chamber 63, thereby not leaking to an exterior of the apparatus. Since the bellows cover 64 has no sliding portion, the incompressible medium 38 leaked from a region between both the sliding faces 61 and 62 is prevented from leaking to the outside from the seal chamber 63 or being scattered.

When the volume of the piston-side drive chamber 36 is increased by moving the piston 34 backward, the incompressible media 38 in each of both the drive chambers 18 and 36 is in a negative pressure state, so that even if the incompressible medium 38*a* enclosed in the seal chamber 63 flows back and enters into the drive chamber 36, a projecting end portion of the piston 34 is shielded from the outside by the bellows cover 64 and therefore no external air enters into the drive chambers 18 and 36.

Further, since molecular weight of the incompressible media 38 and 38*a* such as liquid is larger than that of air, it is difficult that the incompressible media pass through fine gaps between the seal member 69 and the sliding faces 61 and 62. Therefore, the amount of the incompressible medium 38*a* entering into the drive chamber 36 from the seal chamber 63 gets less in comparison with air. Thus, discharge accuracy of the chemical liquid from the pump 11 can be kept at a high level for a long period of time by enclosing the incompressible medium 38*a* such as liquid in the seal chamber 63.

Further, the seal member 69 for sealing a region between the sliding face 62 of the piston 34 and the sliding face 61 of the cylinder hole 33 is used as a boundary to fill both axial-directional sides of the seal member 69 with the incompressible media 38 and 38*a*, respectively. Accordingly, the incompressible media 38 and 38*a*, which have become thin-film shapes, are interposed between the seal member 69 and the outer peripheral surfaces of the piston 34, whereby a lubricating property of the seal member 69 is enhanced and the frictional wear of the seal member 69 is prevented. Consequently, durability of the seal member 69 is improved, and lifetime of the apparatus can be prolonged.

Further, even when the seal member 69 is worn due to use in a long period and its sealing property is reduced, air can be prevented from entering into the drive chambers 18 and 36, so that a reciprocation stroke of the piston 34 can be caused to correspond to the discharge amount of the chemical liquid from the flexible tube 16 with high accuracy. Therefore, when photoresist liquid is applied to a liquid crystal glass substrate, a predetermined amount of photoresist liquid can be discharged from the application nozzle 29 with high accuracy.

In order to detect pressure of the incompressible medium 38*a* in the seal chamber 63, a seal-chamber pressure sensor 71 serving as a seal-chamber pressure detecting means is attached to the cylinder 12. In order to detect pressure of the incompressible medium 38 in the drive chamber 36, a drive-chamber pressure sensor 72 serving as a drive-chamber pressure detecting means is attached to the cylinder 12. The respective sensors 71 and 72 output electric signals corresponding to their pressure.

Figure 3:
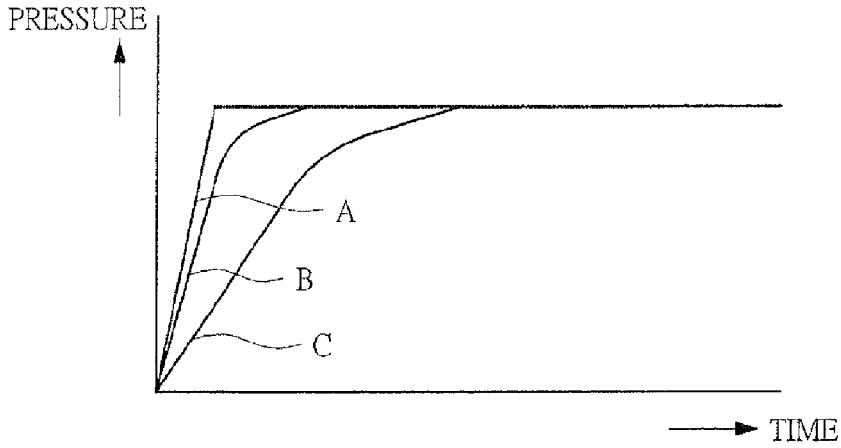
FIG. 3 is a graph showing a pressure change of chemical liquid in a pump chamber when a pump discharge process for discharging the chemical liquid is started.

FIG. 3 is a graph showing a pressure change of the chemical liquid in the pump chamber 17 at a time of staring a pump discharge process of contracting the pump chamber 17 and discharging the chemical liquid by advancing the piston 34 toward its bottom face 35. This pressure change substantially corresponds to a pressure change of the incompressible media in the drive chambers 18 and 36.

A waveform "A" in FIG. 3 indicates a pressure change characteristic of the pump chamber 17 when the seal member 69 exerts a desired sealing effect. When the discharge is started, the pressure in the pump chamber 17 changes so as to rise up steeply, so that the pressure is detected by the drive-chamber pressure sensor 72. Such a steep change can be achieved by forming the drive chamber using the piston 34 instead of the bellows. However, if the seal member 69 is worn or the sliding face 62 of the piston 34 and the sliding face 61 of the cylinder hole 33 are worn so that the sealing property between the sliding faces 61 and 62 are deteriorated, the amount of the incompressible medium 38 leaking into the seal chamber 63 from the drive chamber 36 increases. Consequently, the characteristic indicated by the waveform A cannot be maintained, and a smooth rising change as shown by a waveforms "B" to a waveform "C" occurs according to progress of the deterioration of the sealing property.

That is, when the sealing property is deteriorated, the movement resistance of the incompressible medium 38 from the drive chamber 36 to the seal chamber 63 becomes small at a time of discharging the chemical liquid, so that the amount of medium leaking from the drive chamber 36 increases. Therefore, a thrust force of the piston 34 is not accurately transmitted to the pressures in the drive chambers 18 and 36, whereby the characteristic of the drive chamber 36 becomes smooth rising as shown by the waveforms B and C in FIG. 3. As the pressure in the drive chamber 36 can be detected by the drive-chamber pressure sensor 72, when the rising characteristic exceeds its tolerable value, it is possible to determine a period of replacing the seal member 69 due to the deterioration of the sealing properties exceeding its tolerable range.

When the chemical liquid is sucked into the pump chamber 17 by moving the piston 34 backward, the pressure in the pump chamber 17 hardly needs to be steeply changed. However, if the sealing property is deteriorated, the amount of the incompressible medium 38*a* moving from the seal chamber 63 to the drive chamber 36 in a pump-suction process increases, so that the period of replacing the seal member 69 can be determined also by the pressure change of the drive chamber 36 at the time of suction.

Therefore, a deterioration degree of the sealing property, i.e., a leakage degree of the incompressible media 38 and 38*a* can be detected according to an output signal from the seal-chamber pressure sensor 71 for detecting the pressure in the seal chamber 63 and an output signal from the drive-chamber pressure sensor 72 for detecting the pressure in the drive chamber 36.

Figure 4:
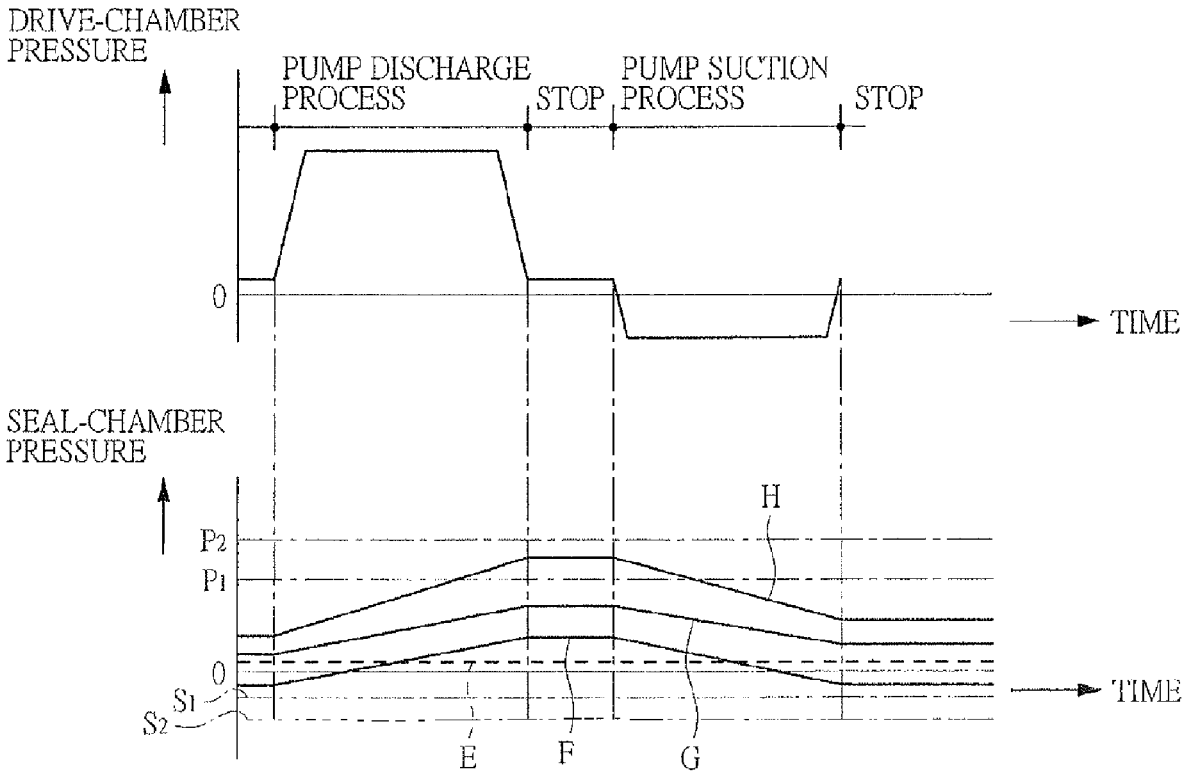
FIG. 4 is graphs showing respective changes in drive-chamber pressure and seal-chamber pressure in one cycle of a pump discharge process and a pump suction process.

FIG. 4 is a graph showing each of changes in drive-chamber pressure and seal-chamber pressure in a single cycle of a pump discharge process and a pump suction process.

In the pump discharge process of advancing the piston 34 and the pump suction process of retreating the piston 34, the pressures in the drive chambers 18 and 36 varies with time as shown by the graph of the drive-chamber pressure in FIG. 4. In contrast, if the seal member 69 exercises a desired sealing property, the leakage of the incompressible medium 38 into the seal chamber 63 from the sliding faces 61 and 62 does not occur, so that both in the pump discharge process and the pump suction process by reciprocating the piston 34, the pressure in the seal chamber 63 maintains an initial value "E" without any change. Although the initial value E may be slightly higher than a gauge pressure of zero since the incompressible medium 38*a* is enclosed in the seal chamber 63, this initial value may be set to zero or any value under negative pressure.

If the deterioration of the sealing property progresses, the amount of the incompressible medium 38 leaking to the seal chamber 63 from the drive chamber 36 in the pump discharge process increases so that the pressure in the seal chamber 63 becomes higher than the initial value E. Contrary to this, the amount of the incompressible medium 38*a* leaking to the drive chamber 36 from the seal chamber 63 increases in the pump suction process, and the pressure in the seal chamber 63 becomes lower than the initial value, whereby a negative pressure value increases with respect to a gauge pressure of zero. Thus, a leakage degree due to the deterioration of the sealing property can be determined by detecting the pressure in the seal chamber 63. Incidentally, although the pressure change of the seal chamber 63 is lower than that of the drive chambers 18 and 36, the pressure change of the seal chamber 63 in FIG. 4 is shown so as to be larger than that of the drive chamber in order to be easily understood.

It is assumed that, as shown by the seal-chamber pressure in FIG. 4, two values of thresholds "P1" and "P2" are set as pressure values for determining the deterioration degree of the sealing property at the time of discharge. At this time, if the pressure value exceeds the threshold P1, it is possible to determine by a detection signal from the seal-chamber pressure sensor 71 that the deterioration of the sealing property progresses to some extent. When the pressure value exceeds the threshold P2, it is possible to determine that the sealing property is deteriorated to such an extent that the seal member 69 needs to be replaced. On the other hand, if two values of thresholds "S1" and "S2" are set as deterioration determining pressure values in a pump suction process, a deterioration degree can be determined in the same manner.

Even if the deterioration degree of the sealing property is uniform, the pressure change in the seal chamber 63 varies according to the pressures in the drive chambers 18 and 36 due to the viscosity of the chemical liquid and the circulation resistance of the discharge-side flow path 26. Therefore, the thresholds for determining the deterioration of the sealing property can be changed according to the pressures in the drive chambers 18 and 36.

Characteristic lines "F" and "G" in FIG. 4 show the pressure changes of the seal chamber 63 when frictional wear of the seal member 69 starts and the sealing property is slightly deteriorated. The characteristic line F indicates the pressure change when the pressure in the drive chambers 18 and 36 does not rise high in the pump discharge process similarly to the case where the viscosity of chemical liquid is low or where flow resistance of the discharge-side flow path 26 of the pump 11 is low. Since the pressure in the drive chambers 18 and 36 does not rise high, pressure corresponding to the characteristic line F is lower than a gauge pressure of zero in the pump suction process.

In contrast, even when the deterioration degree of the sealing property is the same as a case shown by the characteristic line F, a case where the pressure in the pump chamber 17 in the pump discharge process may be higher than the above-mentioned case is a case where the viscosity of the chemical liquid is high or where the discharge-side flow path is provided with the filter. In this time, the pressure in the seal chamber 63 becomes higher than the characteristic line F and the pressure at a time of stopping the pump is also higher than the initial value. Further, when the pressure in the pump chamber 17 is high, the pressure in the seal chamber 63 at the time of stopping the pump gradually rises up from the initial value E. However, the pressure at the time of stopping the pump may return to an initial condition due to a change in a pump operating condition. For example, such a case includes a condition in which she pump is stopped in a long period of time or which interiors of the drive chambers 18 and 36 become in negative pressure states by increasing flow velocity at a time of suction.

Even when the pressure in the drive chambers 18 and 36 in the pump discharge process is the same as the pressure corresponding to the characteristic line F, if the deterioration of the sealing property progresses, the leakage degree of the incompressible media 38 and 38*a* is increased so that the pressure in the seal chamber 63 in the pump discharge process exceeds the threshold P1. Thus, the degree of the sealing property can be determined by detecting the pressure in the seal chamber 63 using the seal-chamber pressure sensor 71. If the amount of leakage of the medium increases further, the pressure in the seal chamber 63 exceeds the threshold P2.

Figure 5:
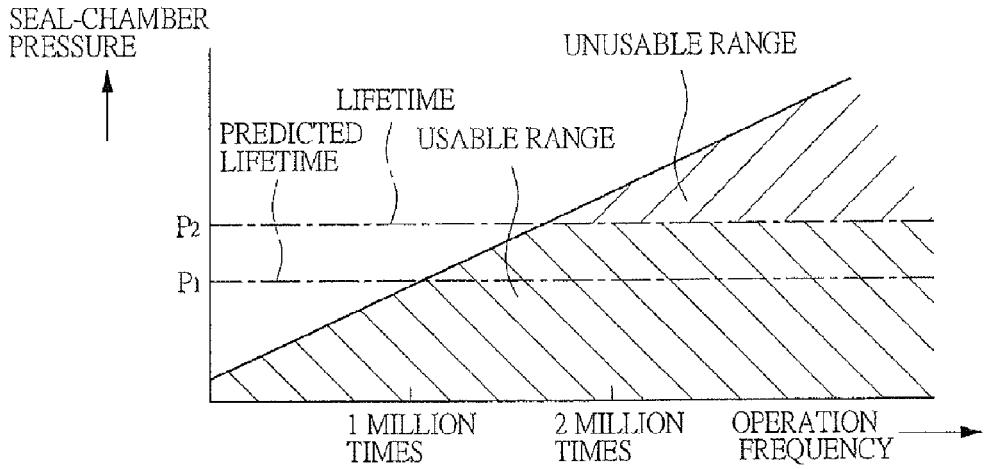
FIG. 5 is a graph schematically showing one example of a change in a peak value of pressure in the seal chamber in the pump discharge process according to an increase of an operation frequency of the pump.

FIG. 5 is a graph schematically showing an example of a change of a peak value of the pressure in the seal chamber 63 in the pump discharge process according to an increase of the operating frequency of the pump. It is assumed that the threshold P2 shown in FIG. 4 is a replacement period of the seal member, namely, a lifetime of the seal member. At this time, if the operating frequency of the pump carried out until the seal-chamber pressure reaches the threshold P2 from the threshold P1 is previously known, the lifetime of the seal member 69 can be predicted when the seal-chamber pressure exceeds the threshold P1. Further, if the relationship between the operating frequency and the peak value of the seal-chamber pressure is previously known, the lifetime of the seal member can be predicted from any detection pressure. Incidentally, the lifetime of the seal member can be predicted in the pump suction process based on the thresholds S1 and S2 shown in FIG. 4. Incidentally, the term "predicted lifetime" in FIG. 5 means a threshold value for predicting lifetime.

Figure 6:
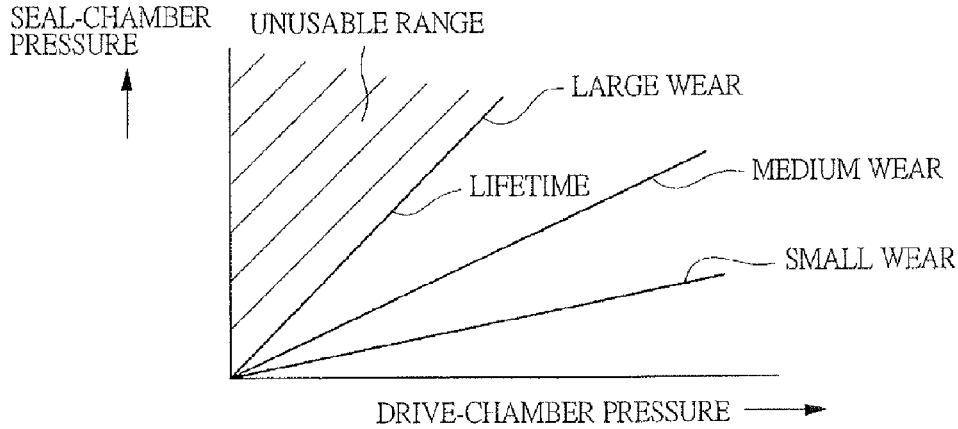
FIG. 6 is a graph showing a relationship between the pressure in the drive chamber and the pressure in the seal chamber in the pump discharge process.

FIG. 6 is a graph showing a relationship between the pressures in the drive chambers 18 and 36 and the pressure in the seal chamber 36 in the pump discharge process. As shown in FIG. 6, as the pressures in the drive chambers 18 and 36 increase, the amount of leakage of the medium to the seal chamber 63 increases, and as the deterioration of the sealing property progresses, the amount of leakage of the medium is increased. That is, there is such a tendency that as the pressure in the drive chambers 18 and 36 increases, the pressure in the seal chamber 63 becomes high. Therefore, if the operation of the pump is carried out under a fixed condition and the pump pressure at the chemical-liquid discharge is constant, the lifetime of the seal member 69 can be determined by the pressure change of the seal chamber 63. If the pressure in the pump chamber 17 at the chemical-liquid discharge rises according to progress of a clogging of the filter 28 provided in the discharge-side flow path 26, the pressure in the seal chamber 63 may exceed the threshold even if the seal member 69 has not reached the lifetime.

For this reason, the pressure in the drive chamber 36 is detected by the drive chamber pressure sensor 72. Therefore, for example, if the deterioration of the sealing property is determined by a difference between the pressure in the drive chamber 36 and the pressure in the seal chamber 63, or if the threshold of the pressure in the seal chamber 63 is varied according to the pressure in the drive chamber 36, the lifetime of the seal member 69 can be determined more accurately regardless of the pressure change of the discharge-side flow path 26 due to the clogging of the filter.

Figure 7:
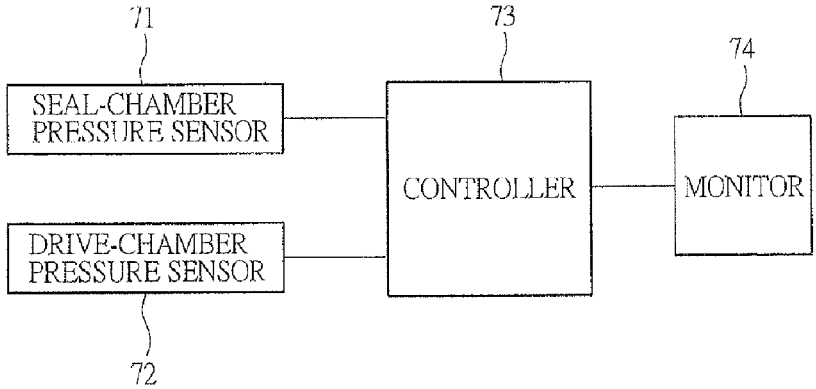
FIG. 7 is a block diagram showing a control circuit of the chemical liquid supplying apparatus.

FIG. 7 is a block diagram showing a control circuit of the chemical liquid supplying apparatus, whereby detection signals of the seal-chamber pressure sensor 71 and the drive-chamber pressure sensor 72 are sent to a controller 73 and a signal from the controller 73 is sent to a monitor 74, so that the sealing property is displayed on the monitor 74. The controller 73 includes: a ROM in which a control program, a lifetime computing equation, a data table of thresholds, and the like are stored; a micro processor for computing the deterioration degree of the sealing property based on the detected signals; and the like. Thus, as shown in FIG. 4, the deterioration degree of the sealing property is determined by the pressure in the seal chamber 63, the pressure in the drive chamber 36, or the pressure in the seal chamber 63 as well as the pressure in the drive chamber 36. The monitor 74 displays the deterioration degree thereof, coming of the lifetime of the seal member 69, or prediction about coming periods of the lifetime of the seal member 69. When the seal member 69 reaches the lifetime, alarms may be issued or alarm lamps may be lit in addition to the monitor 74.

Figure 8:
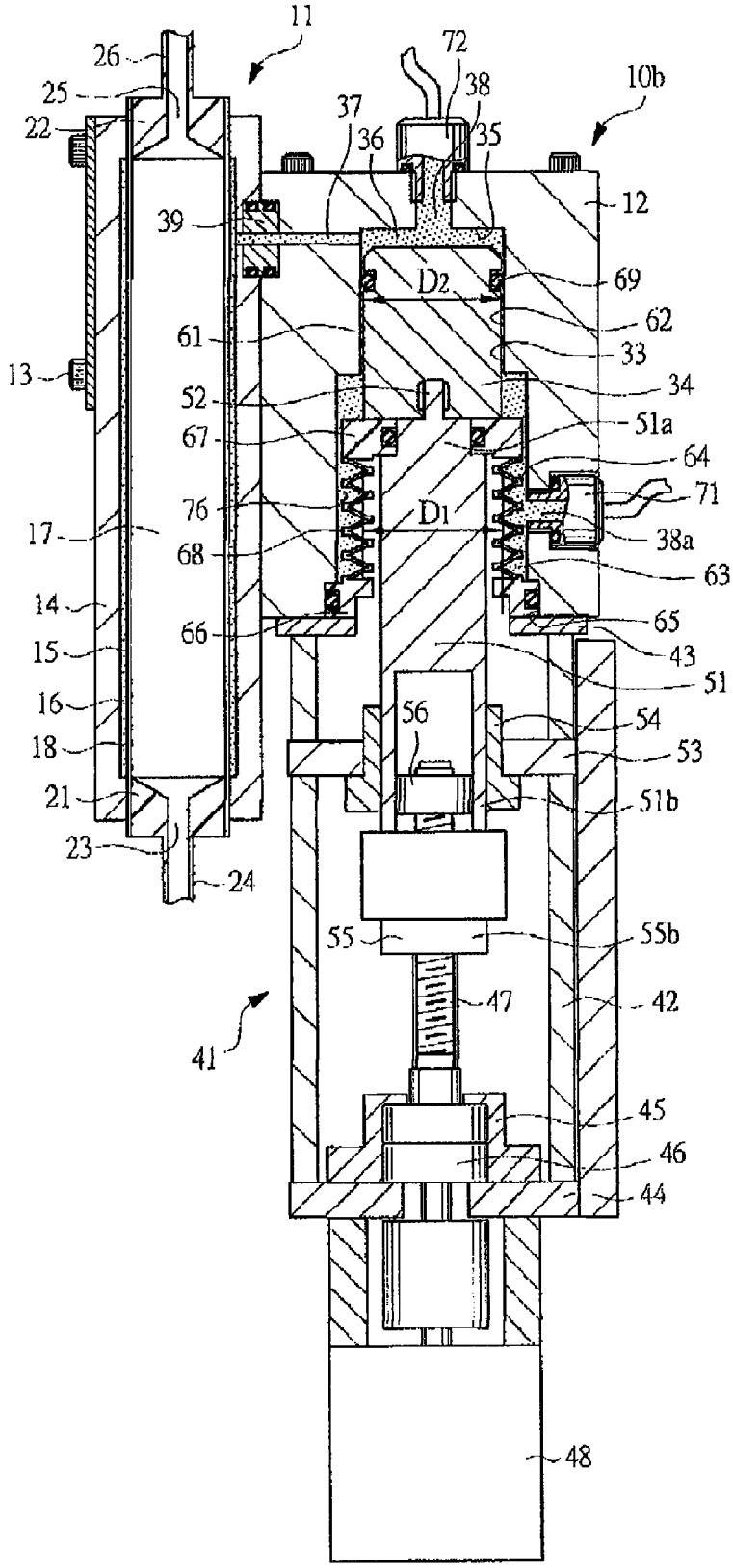
FIG. 8 is a sectional view showing a chemical liquid supplying apparatus according to another embodiment of the present invention.
Figure 9:
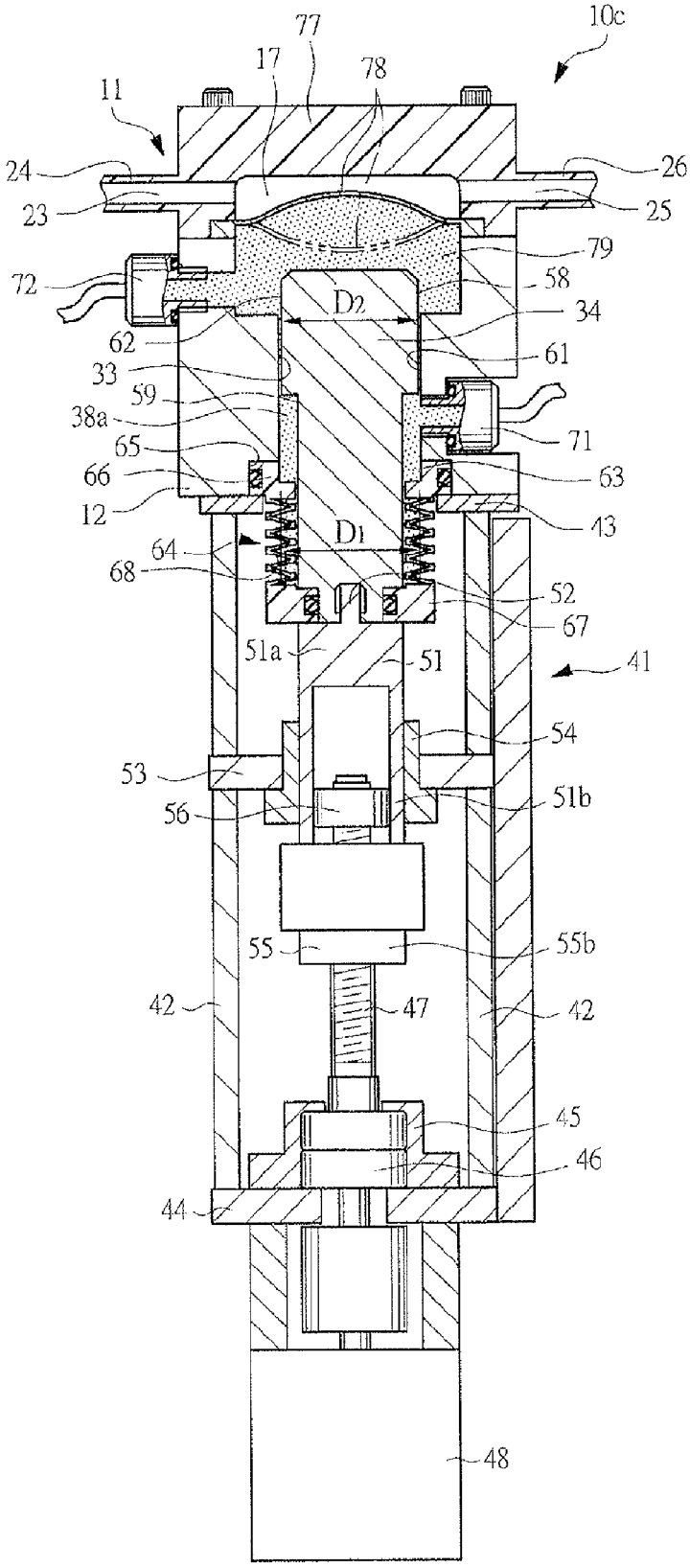
FIG. 9 is a sectional view showing a chemical liquid supplying apparatus according to still another embodiment of the present invention.

FIGS. 8 and 9 are sectional views showing chemical liquid supplying apparatuses according to other embodiments of the present invention, respectively. In these drawings, members common to those in the chemical liquid supplying apparatus shown by FIG. 1 are denoted by the same reference numerals.

An entirety of the piston 34 of a chemical liquid supplying apparatus 10*b* shown by FIG. 8 has the same axial-directional diameter. The cylinder hole 33 of the cylinder 12 has the sliding face 62 which slidably contacts with the outer peripheral surface, i.e., the sliding face 61 of the piston 34; and a large-diameter hole 76 with a diameter larger than an inner diameter of the sliding face 62. The bellows cover 64 is provided between the basal end portion of the piston 34 and an opening end portion of the cylinder 12, and the seal chamber 63 is formed between the bellows cover 64 and the large-diameter hole 76. The bellows cover 64 has: the annular portion 66 fixed to the large-diameter hole 76 formed at the opening end portion of the cylinder 12; the annular portion 67 fixed to a projection portion, i.e., the basal end portion of the piston 34; and the bellows portion 68 provided therebetween. The incompressible medium 38*a* for sealing is enclosed in the seal chamber 63.

The average effective diameter D1 of the bellows portion 68 of the bellows cover 64 is set so as to be approximately equal to the outer diameter D2 of the sliding face 61 of the piston 34. Therefore, similarly to the case shown in FIG. 1, when the piston 34 is reciprocated axially and the bellows portion 68 of the bellows cover 64 is elastically deformed axially, a volume of the seal chamber 63 does not change. Also in the chemical liquid supplying apparatus 10*b* shown in FIG. 8, if a case where the outer diameter D2 is approximately equal to the average effective diameter D1 is included within an allowable error in a degree of not losing durability of the bellows cover 64, setting the inner diameter of the cylinder hole 33 to the average effective diameter D1 is also included within an allowable error of the outer diameter D2.

In the chemical liquid supplying apparatus 10*b* shown in FIG. 8, an annular groove formed on the outer peripheral surface of the piston 34 is provided with the seal member 69 for sealing a region between the sliding face 62 of the cylinder hole 33 and the sliding face 61 of the piston 34.

In the chemical liquid supplying apparatus 10*c* shown in FIG. 9, a portion of the cylinder 12 which corresponds to a portion located in front of the tip surface of the piston 34 is opened, and a pump case 77 is attached to the tip surface of the opened cylinder 12 so as to be opposed to the tip surface of the piston 34. The pump case 77 is formed of PFA, and the pump case 77 is provided integrally with the supply-side flow path 24 and the discharge-side flow path 26. However, the supply-side flow path 24 and the discharge-side flow path 26 may be separated from the pump case 77 and then be attached to the pump case 77.

Between the pump case 77 and the cylinder 12, a diaphragm 78 formed of a resin material such as PTFE or of an elastic material such as rubber is attached as a pump member, and the pump 11 is composed of the pump case 77 and the diaphragm 78. A space between the pump case 77 and the cylinder 12 is partitioned into the pump chamber 17 and the drive chamber 79 by the diaphragm 78, and the diaphragm 78 serves as a partition film.

In the chemical liquid supplying apparatus 10*c* shown in FIG. 9, the drive chamber 79 partitioned by the diaphragm 79 serves as the pump-side drive chamber 18 and the piston-side drive chamber 36 in the aforementioned embodiment. Therefore, the chemical liquid supplying apparatus 10*c* can be downsized smaller in a width-directional dimension than the chemical liquid supplying apparatuses 10*a* and 10*b*.

In the chemical liquid supplying apparatus 10*c* shown in FIG. 9, the seal member 69 for sealing a gap between the sliding face 61 of the cylinder hole 33 and the sliding face 62 of the piston 34 is not provided, and since the gap between the sliding faces 61 and 62 is set to be narrower than the case shown in FIG. 1, the leakage of the incompressible medium from a region between the drive chamber 79 and the seal chamber 63 is prevented without providing the seal member 69. Thus, in the chemical liquid supplying apparatus in which the gap between the sliding face 62 of the piston 34 and the sliding face 61 of the cylinder hole 33 is set to be narrow for obtaining a sealing effect like an injection syringe without using the seal member 69, there is the advantage that a stick-slip phenomenon specific for the seal member does not occur, thereby making it possible to discharge stably the chemical liquid. When the seal member is not used, there is generally the drawback that the leakage of the incompressible medium and entering of air into the drive chamber 79 occur easily, thereby deteriorating the sealing property. However, the bellows cover 64 provided between the piston 34 and the cylinder 12 forms the seal chamber 63, so that such a drawback is eliminated and accordingly the durability of the chemical liquid supplying apparatus 10*c* can be improved while the stable discharge of the chemical liquid is maintained.

Incidentally, also in the chemical liquid supplying apparatuses 10*a* and 10*b* mentioned above, if the gap is set to be narrow, use of the seal member 69 is unnecessary. Further, in the case of using the seal member 69, a wear ring as a bearing may be mounted between the piston 34 and the cylinder 12. Or, instead of the seal member 69, the wear ring may be mounted.

In such a type of the chemical liquid supplying apparatus 10*c*, when both the sliding faces 61 and 62 are worn frictionally and the leakage degree of the incompressible medium from the gap therebetween reaches a predetermined value or more, coming of the lifetime of the apparatus itself is determined and replacement or maintenance of the piston 34 and the cylinder 12, etc. are carried out.

Also in the chemical liquid supplying apparatuses 10*b* and 10*c* shown in FIGS. 8 and 9, the lifetime due to the deterioration of the sealing property can be determined by the control circuit shown in FIG. 7.

The present invention is not limited to the above mentioned embodiments and may be variously modified within a scope of not departing from the gist thereof. For example, although the piston 34 is driven by the motor 48, the driving means is not limited to the motor 48 and other driving means such as a pneumatic cylinder may be used. Further, the seal-chamber pressure detecting means and the drive-chamber pressure detecting means are not limited to sensors for transmitting an electric signal according to the pressure, and a switch for issuing an ON signal when each pressure exceeds a predetermined value may be used or pressure according to which a member is moved may be displayed outside.

What is claimed is:

1. A chemical liquid supplying apparatus comprising:

a pump provided with an elastically deformable partition film for partitioning a drive chamber and a pump chamber communicating with a liquid inflow port and a liquid outflow port;

a cylinder incorporating reciprocably, into the drive chamber, a piston for supplying/exhausting an incompressible medium to/from the drive chamber, the cylinder having a sliding face on which a sliding face of the piston slides;

a driving means for reciprocating axially the piston to expand/contract the pump chamber via the incompressible medium; and an elastic deformable member provided between the piston and the cylinder and forming a seal chamber for enclosing the incompressible medium so as to be contiguous to the sliding face of the piston, the elastic deformable member being formed by a bellows cover, the average effective diameter of the bellows cover being set so as to be approximately equal to an outer diameter of the sliding face of the piston.

2. The chemical liquid supplying apparatus according to claim 1, wherein a small-diameter portion with a diameter smaller than the outer diameter of the sliding face is formed on the piston, the bellows cover is provided between an opening end portion of the cylinder and a basal end portion of the piston, and the seal chamber is formed between the bellows cover and the small-diameter portion.

3. The chemical liquid supplying apparatus according to claim 1, wherein a large-diameter hole with a diameter larger than an inner diameter of the sliding face of the cylinder is formed on the cylinder, the bellows cover is provided between a basal end portion of the piston and an opening end portion of the cylinder, and the seal chamber is formed between the bellows cover and the large-diameter hole.

4. The chemical liquid supplying apparatus according to claim 1, further comprising a seal-chamber pressure detecting means for detecting pressure in the seal chamber.

5. The chemical liquid supplying apparatus according to claim 1, further comprising a drive-chamber pressure detecting means for detecting pressure in the drive chamber.

6. The chemical liquid supplying apparatus according to claim 1, wherein the drive chamber is partitioned by the piston and a partition film provided in the cylinder.

7. The chemical liquid supplying apparatus according to claim 1, wherein the drive chamber comprises a pump-side drive chamber provided to the pump and a piston-side drive chamber formed by the cylinder and the piston.

8. The chemical liquid supplying apparatus according to claim 1, wherein the partition film is a diaphragm.

9. The chemical liquid supplying apparatus according claim 1, wherein the partition film is a tube.

* * * * *